US005100240A

United States Patent [19]

D'Alterio

[11] Patent Number: 5,100,240

[45] Date of Patent: Mar. 31, 1992

[54] HIGH-SPEED CONTINUOUS MIXER FOR SOLIDS AND LIQUIDS

[76] Inventor: Joseph C. D'Alterio, 64 Sugar Maple La., Glen Cove, N.Y. 11542

[21] Appl. No.: 522,317

[22] Filed: May 11, 1990

[51] Int. Cl.[5] ..... B01F 3/12; B01F 7/02; B01F 15/02

[52] U.S. Cl. ..... 366/99; 366/156; 366/185; 366/303

[58] Field of Search ..... 366/81, 65, 70, 77, 366/309, 144, 325, 185, 156, 312, 313, 331, 279, 325, 97, 98, 99

[56] References Cited

U.S. PATENT DOCUMENTS

| | | | |
|---|---|---|---|
| 173,401 | 2/1876 | Ford | 366/65 |
| 442,213 | 12/1890 | Young | 366/309 |
| 737,583 | 1/1903 | Coffey | 366/144 |
| 739,688 | 4/1903 | Laprade | 366/325 |
| 1,947,487 | 2/1934 | Newhouse | 366/156 |
| 2,460,987 | 2/1949 | Kanhofer | 366/307 |
| 2,781,563 | 2/1957 | Horth | 366/279 |
| 2,907,555 | 4/1955 | Engels | 366/77 |
| 3,346,242 | 10/1967 | List | 366/81 |
| 3,694,227 | 9/1972 | Vezzani | 366/99 |
| 4,609,156 | 9/1986 | Boele | 366/331 |

FOREIGN PATENT DOCUMENTS

| | | | |
|---|---|---|---|
| 3604333 | 12/1986 | Fed. Rep. of Germany | 366/185 |

*Primary Examiner*—Philip R. Coe
*Assistant Examiner*—Terrence R. Till
*Attorney, Agent, or Firm*—Paul W. Garbo

[57] ABSTRACT

A high-speed continuous mixer for solids and liquids has a horizontal tubular vessel with a semi-cylindrical bottom and a mixer shaft coinciding with its axis. Multiple crescent-like flat blades are mounted on the shaft at right angles thereto and clear the semi-cylindrical bottom by a small distance. Each crescent-like blade has a tapered knife edge on its convex periphery which has a sweeping shape to provide, when rotated, a slicing action through the mass undergoing mixing while moving from the feed end to the discharge end of the tubular vessel. Remarkable high-speed production of dough for pasta and baked goods is achieved as an example of the outstanding performance of the mixer.

17 Claims, 3 Drawing Sheets

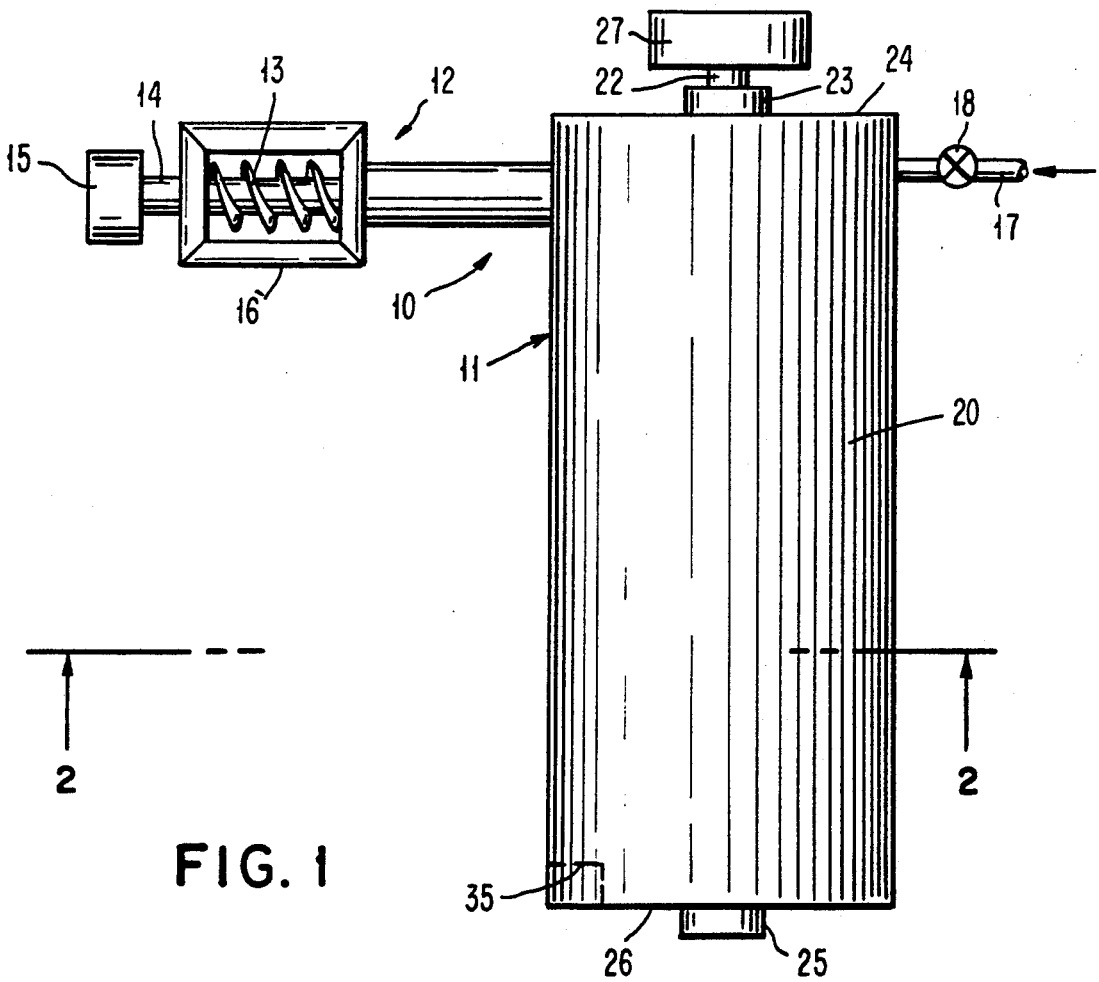
FIG. 1
FIG. 2
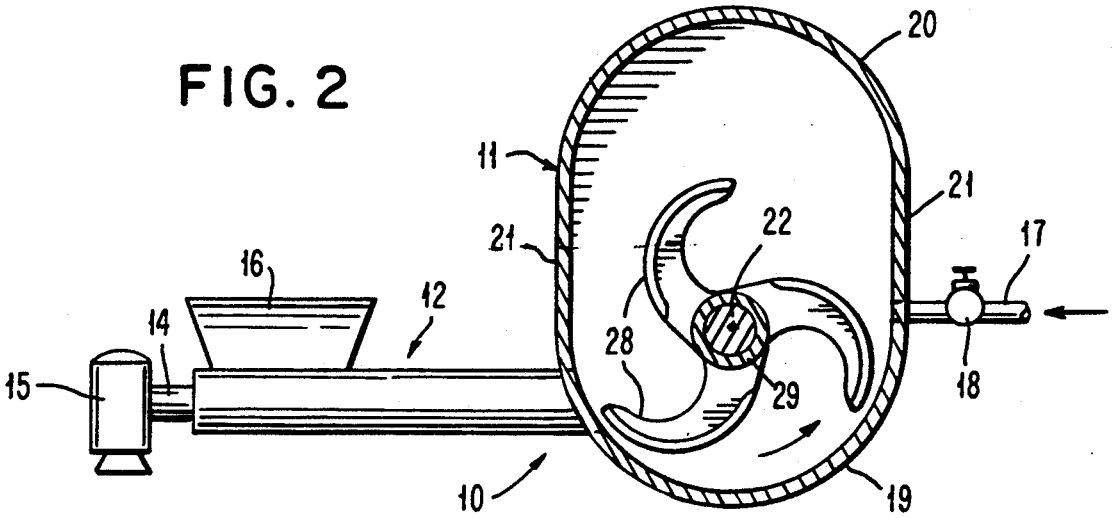

HIGH-SPEED CONTINUOUS MIXER FOR SOLIDS AND LIQUIDS

BACKGROUND OF THE INVENTION

This invention relates to a high-speed continuous mixer for solids and liquids. More particularly, the invention provides such a mixer for uniformly dispersing liquid in powders or powders in liquid.

The mixer art is indeed extensive. High-speed mixers have been proposed in numerous patents. For example, U.S. Pat. No. 3,888,997 to Guilbert discloses a vertical tubular chamber with a centrifugal mixer screw rotatable therein for mixing flour and liquid. Guilbert proposes to rotate the mixer screw at speeds of 3000 to 4000 RPM to hurl the mixture against the inner surface of the chamber from which it is scraped by the edges of the mixer screw.

U.S. Pat. No. 4,010,932 to Otto shows a machine for making and kneading batches of dough which involves two rotatable mixers extending in a horizontal drum from its opposite ends. One mixer has a blade which sweeps along the inner surface of the drum; the other mixer has three spaced three-bladed propellers. While the sweeping blade is rotated at a speed of, for example, 60 RPM, Otto rotates the mixer with the three-bladed propellers at speeds of 750 to 1800 RPM.

In spite of the numerous publications and patents on mixing which have diverse and special requirements and goals, there is still need for a continuous high-speed mixer for producing uniform dispersions of liquids and solids.

Accordingly, a principal object of this invention is to provide a continuous high-speed mixer for rapidly forming uniform dispersions of liquids and solids.

A further object is to provide such a mixer that is relatively simple in construction and stable in operation.

These and other features and advantages of the invention will be apparent from the description which follows.

SUMMARY OF THE INVENTION

In accordance with this invention, a continuous high-speed mixer for rapidly producing uniform dispersions of comminuted solids and liquids comprises a horizontal tubular vessel having a semi-cylindrical bottom and a top that may be also semi-cylindrical or may have another shape that is volumetrically greater than the bottom. A mixer shaft extends across the vessel, coinciding with the axis of the semi-cylindrical bottom. Flat crescent-like blades with a tapered knife edge on the convex periphery of each blade are mounted on, and at right angles to, the shaft usually in spaced relation to one another. The maximum radial dimension of the blades is slightly less than the inside radius of the semi-cylindrical bottom. One end of the shaft passes through one end of the vessel and is connected to an electric motor while the opposite end of the shaft is supported in a bearing mounted at the opposite end of the vessel. Feed openings are provided at or near one end of the vessel for the introduction of comminuted solids and liquid, and a discharge opening is provided at the opposite end of the vessel.

The crescent-like blades are of two principal types: pusher blades wherein the tapered knife edge faces the discharge end of the vessel and neutral blades wherein the tapered knife edge faces both ends of the vessel. Thus, while both types of blades produce intense cutting and turbulence in the mass of comminuted solids and liquid fed into the vessel, the pusher blades have the additional function of moving that mass toward the discharge opening. Clearly, the greater the ratio of pusher blades to neutral blades, the greater will be the speed of the mass moved from the feed end to the discharge end of the vessel. Conversely, decreasing the ratio of pusher blades to neutral blades will decrease the speed of the mass moving through the vessel. Accordingly, depending on the physical properties of the solids and liquids to be processed into uniform dispersions, in some cases the throughput must be decreased by reducing the ratio of pusher blades to neutral blades whereas in other cases the throughput can be increased by increasing the ratio of pusher blades to neutral blades.

Inasmuch as the mixer of the invention is desirably operated at speeds of at least about 900 RPM, to ensure essentially vibrationless operation it is advisable to position the individual blades on the shaft in radial positions that give balance to the shaft with its blades. For example, if the blades are placed in three radial positions that are successively at a uniform angle of 120° different from one another, the total number of blades on the shaft should be a multiple of 3, such as 15 or 21. If the blades are placed in two radial positions differing by an angle of 180°, then a balanced shaft will have an even number of blades such as 14 or 18. When the blades are in four radial positions that are successively apart by 90° angles, the total number of blades should be an even number. If that even number when divided by 4 leaves a remainder of 2, those two blades should radiate from the shaft in completely opposite directions, i.e., at an angle of 180° relative to one another. For instance, if the 90° angle between successive blades is chosen for a mixer with 18 blades, 16 blades will extend in radial directions that deviate by 90° angles from one another and 2 blades will be angularly apart by 180° to balance the shaft.

As previously mentioned, the ratio of pusher blades to neutral blades can be varied to hasten or slow the passage of solids and liquid through the mixer of the invention. In most cases, the ratio of pusher blades to neutral blades will be in the range of 1:1 to 4:1, although a ratio lower than 1:1 or greater than 4:1 may be selected for specific solids and liquid. For any chosen blade ratio, it is preferable to place most of the neutral blades between equal groups of pusher blades. For example, if a shaft is to have 15 pusher (P) blades and 5 neutral (N) blades, a preferred sequence of blades from feed end to discharge end of the mixer is 2P-1N-3P-1N-3P-1N-3P-1N-3P-1N-1P.

The spacing between the individual blades is preferably in the range of ⅜ to 2 inches but other spacing may be used depending on the solids and liquid to be mixed and the desired physical form of the resulting mixture which, for example, might be liquid-impregnated granules or a soft paste or solids in liquid suspension.

The radius of the semi-cylindrical bottom of the mixer vessel is most often in the range of about 2 to 10 inches. The clearance between the crescent-like blades and the semi-cylindrical bottom is usually in the range of about ⅛ to ½ inch.

The introduction of solid material in the form of powder or granules is preferably carried out with a screw conveyor connected to the feed end of the mixer vessel. The liquid may be fed as a continuous stream or as a sprayed mist.

BRIEF DESCRIPTION OF THE DRAWINGS

For further clarification of the invention, the ensuing description will refer to the appended drawings of which:

FIG. 1 is a plan view of a preferred embodiment of the high-speed mixer of the invention;

FIG. 2 is the front view of the mixer of FIG. 1 with a sectional view taken along the line 2—2 through the mixing vessel;

DESCRIPTION OF PREFERRED EMBODIMENTS

Figure 3:
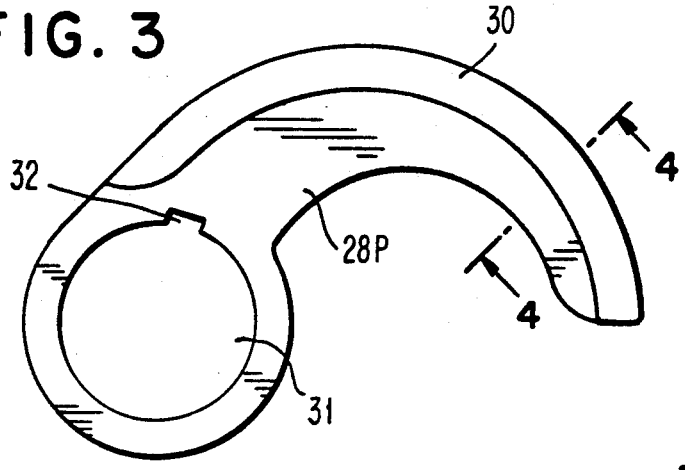
FIG. 3 is a plan view of a typical blade used in the mixer of FIGS. 1 and 2.

FIG. 1 shows that high-speed mixer 10 has mixing vessel 11 with screw conveyor 12 connected to the feed end of vessel 11. Conveyor 12 comprises helical screw 13 with its shaft 14 connected to electric motor 15. Hopper 16 of conveyor 12 provides the inlet of conveyor 12 where flour or other comminuted solids are fed. The rotation of screw 13 by motor 15 advances the solids dropped into hopper 16 until they enter mixing vessel 11. Simultaneously, liquid such as water is fed to mixing vessel 11 through pipe 17 and control valve 18.

Figure 6:
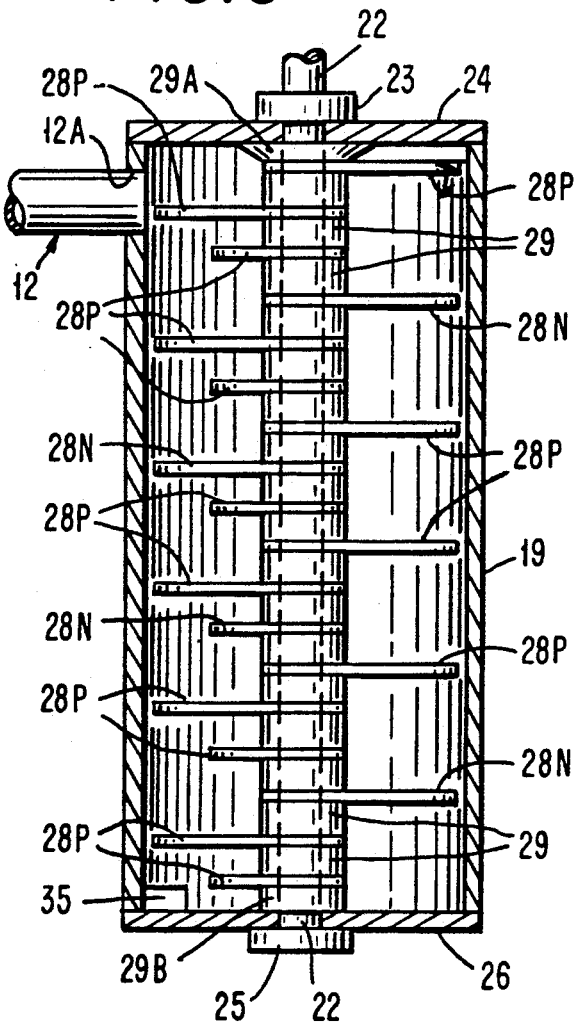
FIG. 6 is an enlarged horizontal sectional view of only the mixing vessel of the mixer of FIGS. 1 and 2, taken through the bearings which support the mixer shaft.
Figure 7:
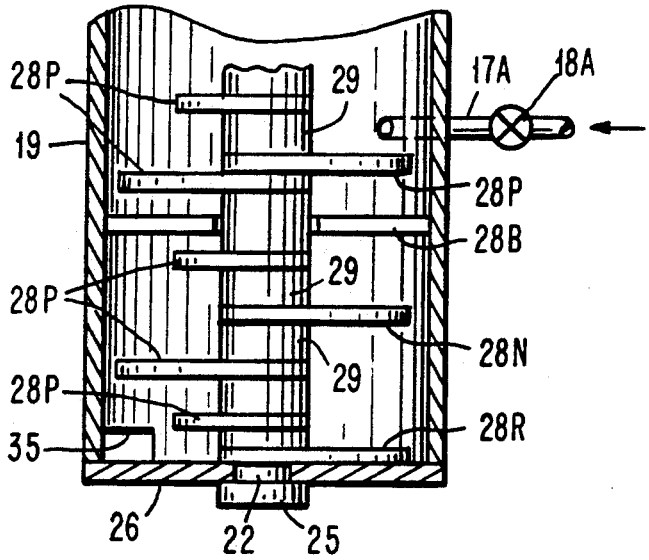
FIG. 7 is a sectional view like FIG. 6 showing only the discharge end of the mixing vessel to illustrate the use of two structural elements not employed in FIG. 6.

FIG. 2 shows mixer 10 with a vertical section of mixing vessel 11 which has semi-cylindrical bottom 19 connected to semi-cylindrical top 20 by vertical walls 21. Semi-cylindrical top 20 with vertical walls 21 has an inverted U-shape. Mixer shaft 22 extends through vessel 11; the axial line of shaft 22 coincides with the axial line of sem-cylindrical bottom 19. Shaft 22 is supported by bearing 23 mounted on feed end wall 24 and by bearing 25 mounted on discharge end wall 26. The discharge opening 35 in semi-cylindrical bottom 19 is best seen in FIGS. 6 and 7. A vertical chute (not shown) is preferably connected to opening 35 for the discharge of the final mixture. Shaft 22 is connected to electric motor 27 which preferably has a variable speed in the range of about 900 to 5000 RPM.

A multiplicity of single blades 28 are mounted on shaft 22 with spacer rings 29 between successive blades 28. Blades 28 are flat metal, preferably polished, with a thickness usually in the range of about 1/16 to $\frac{3}{8}$ inch and have a crescent-like shape. Blades 28 on shaft 22 are oriented in three radial directions that successively differ from a preceding blade 28 by an angle of 120°. The clearance between blades 28 and semi-cylindrical bottom 19 is preferably in the range of about $\frac{1}{8}$ to $\frac{3}{8}$ inch. Spacer rings 29A, 29B are narrower than rings 29 and may even be omitted as later illustrated in FIG. 7.

Figure 4:
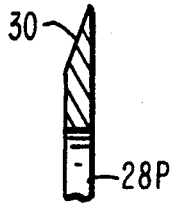
FIG. 4 is a sectional view of part of the blade of FIG. 3 taken along line 4—4 to show the leading or cutting edge thereof.

FIG. 3 shows the side of a crescent-like blade 28 that faces discharge end wall 26 of vessel 11 of FIGS. 1 and 2. This blade serves to impel or push materials from the feed end to the discharge end of vessel 11 and, therefore, will be referred to as pusher blade 28P. The convex periphery of pusher blade 28P has a sharp knife edge 30 that is tapered only on the side of blade 28P which faces the discharge end of vessel 11. The single tapered knife edge 30 is clearly shown in FIG. 4. It is very desirable that knife edge 30 be sharp to reduce the amperage of motor 27. Blade 28P has bore 31 so that shaft 22 can slip therethrough; keyway 32 in bore 31 is used to lock blade 28P on shaft 22 in a desired position. A spline arrangement between shaft 22 and bore 31 of blades 28P is desirable for holding blades 28P in different radial directions.

Figure 5A:
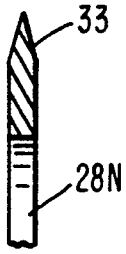
FIGS. 5A and 5B are sectional views similar to FIG. 4 showing two different forms of cutting edge for some blades used in the mixer of FIGS. 1 and 2.

In contrast to pusher blade 28P with single tapered knife edge 30, mixer 10 also has neutral blades 28N which differ from blades 28P only in double tapered knife edge 33 shown in FIG. 5A. Double tapered knife edge 33 of neutral blade 28N impels the materials in mixer 10 equally in opposite directions and thus serves to slow the flow of materials through mixing vessel 11.

Figure 5B:
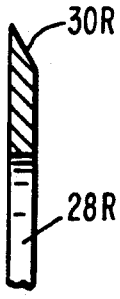
Figure 8:
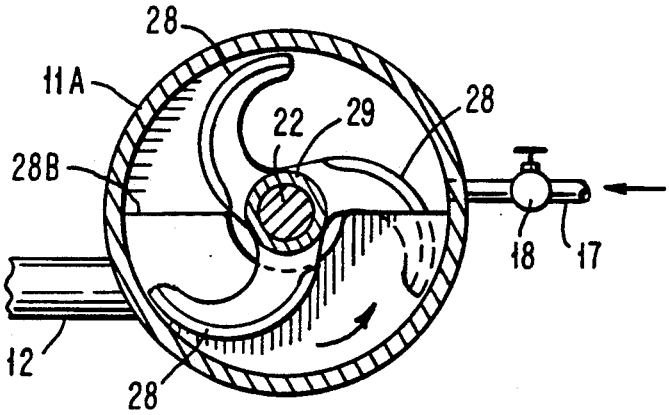
FIG. 8 is a sectional view of a cylindrical mixing vessel, taken at right angles to its axis.

Two other structural elements may be used in vessel 11 to decrease the throughput. A reverse pusher blade 28R, shown in FIG. 5B, is like pusher blade 28P except that the tapered knife edge faces the feed end of vessel 11 and thus tends to impel the solids-liquid mass away from the discharge end. The other slowing element that may be used is a fixed dam or baffle positioned between blades. The baffle is often a semi-circular plate fastened in the bottom of vessel 11 at right angles to its axis. Such a baffle 28B is shown in FIGS. 7 and 8. Baffles of other shapes, such as a quadrant, may be used.

An important feature of the invention is the convex curvature of knife edge 30, 33, 30R of blades 28P, 28N, 28R, respectively. As these blades rotate and cut through the mass of materials in mixer 10, they have a slicing action akin to pulling a knife backwards while moving downward through a Virginia ham to obtain thin slices. This slicing action contrasts with straight, right-angle cutting as exemplified by cutting with a stamping die. In other words, the curvature of sharp knife edges 30, 33, 30R maximizes the sweeping, slicing action of rotating blades 28P, 28N, 28R, respectively. Accordingly, whereas the blades of virtually all mixers exert considerable impact on the materials being mixed not only because the leading edge is blunt but also because the blade is not flat and at right angles to the mixer shaft, blades 28P, 28N, 28R produce a unique and intensive slicing action. As a result, a noteworth feature of the flat crescent-like blades used in this invention is the low consumption of electric power by the motor which rotates the shaft with the blades mounted thereon. A high polish on the blades and sharpening the knife edges of the blades will yield an observable reduction in power consumption. In contrast to prior mixers wherein the blades are not at right angles to the mixer shaft, the mixer of this invention has its flat blades mounted on, and at right angles to, the mixer shaft as clearly shown in FIGS. 6 and 7. Or, in precise terms of geometry, the shaft or axis of rotation is perpendicular to the flat plane of each of the blades.

FIG. 6 shows only semi-cylindrical bottom 19 of mixer 10 with shaft 22 supported by bearings 23, 25 which are usually ball or roller bearings. Mixer 10 as shown in FIG. 6 has 14 pusher blades 28P and 4 neutral blades 28N which are uniformly spaced from one another by spacer rings 29. Narrower rings 29A and 29B are positioned next to feed end wall 24 and discharge end wall 26, respectively. Screw conveyor 12 (not shown in FIG. 6) discharges into semi-cylindrical bottom 19 through opening 12A, only partially visible in FIG. 6.

The sequence of blades 28P, 28N in FIG. 6 from feed end to discharge end of mixer 10 is 3P-1N-3P-1N-3P-1N-3P-1N-2P. Many other sequence variations may be used. Likewise, while the ratio of pusher blades 28P to neutral blades 28N is 3.5:1, smaller and larger ratios are practical for different materials processed by mixer 10. Blades 28P, 28N extend from shaft 22 in three radial directions that progressively differ from a preceding direction by an angle of 120°. This is like saying, if the first blade is at 12 o'clock, the next blade is at 4 o'clock, the next is at 8 o'clock, the next at 12 o'clock and so on. As previously mentioned, blades may be positioned in radial directions that are as far apart as 180° or that are angularly much closer to one another but usually not less than 90° apart.

FIG. 7 is like FIG. 6 but shows only the portion of semi-cylindrical bottom 19 near discharge end 26. FIG. 7 serves to illustrate three variations of the elements that may be used in mixing vessel 11. Reverse pusher blade 28R is shown adjacent end wall 26. Blade 28R serves to prevent the deposition of a sticky mixture on wall 26. As previously mentioned, blade 28R may be positioned at one or more places in the sequence of pusher blades 28P and neutral blades 28N to slow the passage of materials through mixer 10. Another element to decrease the throughput is semi-circular baffle 28B fastened to bottom 19. Baffle 28B may be a segment less than a half circle.

The third variation shown in FIG. 7 is the omission of spacer ring 29 between blades 28P, 28N. Two pusher blades 28P abutted against one another can be seen in FIG. 7, upstream of baffle 28B. Abutted blades 28P and/or 28N are useful in intensifying mixing by the slicing action of the blades.

FIG. 7 further illustrates the use of an auxiliary pipe 17A and valve 18A to supplement the liquid supplied initially by pipe 17 and valve 18 or to add a different liquid. Abutted blades 28P close to the entry point of pipe 17A in bottom 19 help to disperse the added liquid immediately and thoroughly in the mass moving through mixer 10.

FIG. 8 is a sectional view of a cylindrical vessel 11A. In this case, the top as well as the bottom of vessel 11A is semi-cylindrical. Semi-circular baffle 28B is shown between consecutive blades 28.

Figure 9:
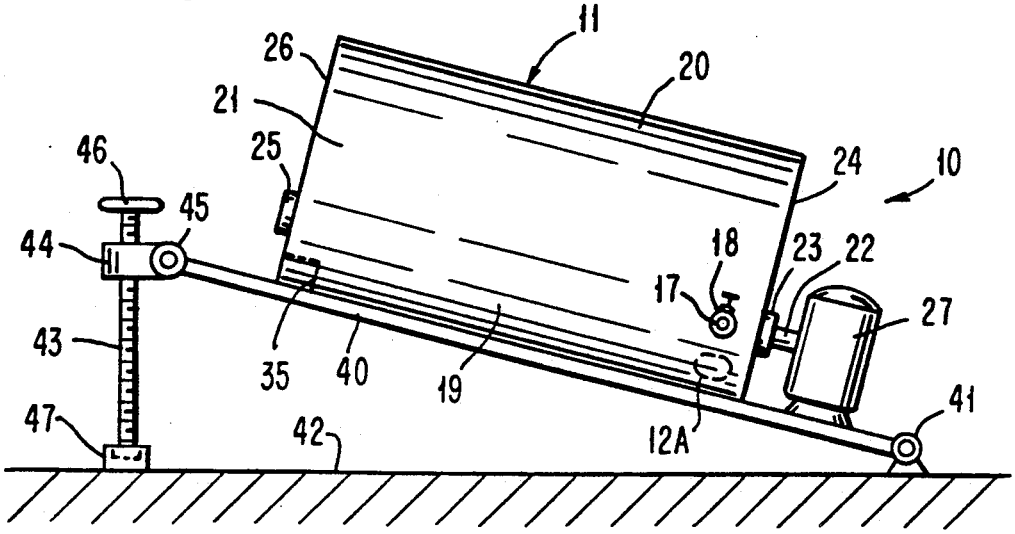
FIG. 9 is a right side view of a mixer like that of FIGS. 1 and 2 mounted on a tiltable plate.

FIG. 9 shows mixer 10 mounted on tiltable plate or platform 40 which has hinge 41 anchored to floor base 42. The opposite end of platform 40 can be raised to a desired elevation by screw rod 43 which passes through threaded block 44, pivotally connected to platform 40 at end 45. Hand-wheel 46 at the top of rod 43 provides the gripping means for turning rod 43. The bottom end of rod 43 rests in bearing block 47 on floor 42. Although discharge opening 35 of mixer 10 may be in end wall 26, as shown in FIGS. 6,7 and 9, it is preferably located in semi-cylindrical bottom 19 of vessel 11. A chute may be connected to opening 35 to direct the discharged mixture into a receptacle. Mixer 10 may be provided with two or three discharge openings 35 at different elevations in vessel 11 for carrying out the mixing of different combinations of comminuted solids and liquid. Of course, each opening 35 would have a closure but only the closure of the selected opening 35 would be open for a particular mixing operation.

The mixer of this invention is ideally suited for the high-speed preparation of dough used in the manufacture of various food products, particularly pasta and baked goods. This is best illustrated by a specific example of mixer 10 of FIGS. 1 and 2, wherein semi-cylindrical bottom 19 and top 20 have a radius of 5 inches and are connected by vertical walls 21 that are 4 inches high. Hence, the maximum height of mixing vessel 11 is 14 inches and the maximum width is 10 inches. In spite of these small dimensions, the rate of production of dough is surprisingly great. Shaft 22 connected to a 5-horsepower electric motor having a variable speed of 1800 to 3600 RPM has pusher blades 28P and neutral blades 28N positioned in three radial directions as shown in FIG. 2 and arranged, starting at feed end 24 of vessel 11, in the sequence 1P-1N-1P-1N-1P-1N- and so on. A total of 36 blades 28P,28N, each 3/32 inch thick, are uniformly spaced from one another by spacer rings 29 that are 9/16 inch wide. The internal length of vessel 11 is 24 inches. The clearance between the tips of blades 28P,28N and semi-cylindrical bottom 19 is ⅛ inch.

Durum flour admixed with 2% by weight of powdered eggs is fed to mixer 10 by screw conveyor 12 while water is supplied by pipe 17; for each 100 pounds of flour and 2 pounds of eggs, 31 pounds of water is added. With motor 27 operating at 1800 RPM, a homogeneous dough is produced in the form of small granules or pellets that freely pour out of discharge opening 35 at the rate of 65 pounds per minute or slightly more than 1 pound per second. What is very unusual of the pellets discharged by mixer 10 is their ability to remain to a considerable extent unattached to one another and yet if they are pressed together they readily fuse into a smooth, homogeneous dough. This is easily observed by taking a handful of the pellets and clenching the fist; the resulting mass of dough is soft and supple.

Those skilled in dough preparation will appreciate that the dough with a water content of only 23% by weight is as soft and moldable as dough made with conventional mixers, often requiring more water and certainly more mixing time.

The 5-horsepower motor connected to shaft 22 shows 16.5 amperes and 220 volts on its name plate. Operating mixer 10 empty, the motor draws only 1.1 amperes. Feeding the materials in the stated proportions to produce 65 pounds of dough per minute or 3900 pounds per hour, the motor draws slightly less than 5 amperes. An hourly throughput of nearly 2 tons is amazing for a mixing vessel 11 of such small dimensions, particularly inasmuch as the total power consumption is only 1.5 horsepower.

Many variations and modifications of the invention will be apparent to those skilled in the art without departing from the spirit or scope of the invention. For example, the means for feeding the comminuted solids to mixing vessel 11 may be a chute or funnel attached to semi-cylindrical top 20 which may have another shape such as a flat or hip roof. The liquid may be introduced into vessel 11 through one opening together with the comminuted solids; for instance, pipe 17 with valve 18 may be connected to screw conveyor 12 near the end that discharges into vessel 11. While spacer rings 29 are generally used between blades 28, a mixer designed for extremely intensive mixing may have all of blades 28 abutted together or may use a few spacer rings 29 between groups of abutted blades 28. Although a principal use of the mixer of this invention is the high-speed mixing of comminuted solids and liquids to yield very uniform mixtures, two or more powders may be passed through the mixer without a liquid to produce an extremely uniform blend. Likewise, two or more immiscible liquids may be fed to the mixer to yield an emulsion. Desirably, the upper portion of mixing vessel 11 should be removable or hinged to permit access for cleaning at the end of a mixing operation. Accordingly, only such limitations should be imposed on the invention as are set forth in the appended claims.

What is claimed is:

1. A continuous high-speed mixer for rapidly producing uniform mixtures of at least two materials, which comprises a horizontal tubular vessel having a semi-cylindrical bottom and a top having a volume that provides at least a semi-cylindrical portion equal and contiguous to that of said bottom, at least one feed opening at one end of said vessel and a discharge opening at the opposite end of said vessel, a mixer shaft extending horizontally across said vessel, the axis of said shaft coinciding with the axis of said bottom, a series of spaced flat crescent-like blades mounted sequentially on said shaft which is perpendicular to the flat plane of each of said blades, each of said blades having a convex periphery with a tapered knife edge on said convex periphery, some of said blades having said tapered knife edge facing toward said discharge opening to push materials undergoing mixing toward said discharge opening, thus defining pusher blades, and other of said blades facing toward the opposite ends of said vessel to push said materials toward said opposite ends, thus defining neutral blades, the maximum radial dimension of said blades being slightly less than the inside radius of said bottom, one end of said shaft passing through one end of said vessel and being connected to an electric motor and the opposite end of said shaft being supported in a bearing mounted at the opposite end of said vessel.

2. The mixer of claim 1 wherein the pusher blades and neutral blades are arranged in a repetitive sequence.

3. The mixer of claim 2 wherein the number of pusher blades in the repetitive sequence is in the range of 1 to 4 for each neutral blade.

4. The mixer of claim 3 wherein the pusher blades and neutral blades have a thickness of 1/16 to ⅜ inch.

5. The mixer of claim 4 wherein the radius of the semi-cylindrical bottom of the vessel is in the range of 2 to 10 inches, the clearance between the blades and said bottom is in the range of ⅛ to ½ inch, and the discharge opening is in said bottom.

6. The mixer of claim 5 wherein the feed opening has a screw conveyor connected thereto, and a pipe for feeding liquid is connected to the vessel near said feed opening.

7. The mixer of claim 1 wherein the semi-cylindrical bottom of the vessel is connected to a top with an inverted U-shape.

8. The mixer of claim 7 wherein the clearance between all of the blades and the semi-cylindrical bottom of the vessel is in the range of ⅛ to ½ inch, and all of said blades have a thickness of 1/16 to ⅜ inch.

9. The mixer of claim 1 wherein the top of the vessel is volumetrically at least 50% greater than the semi-cylindrical bottom.

10. The mixer of claim 1 wherein the top of the vessel is semi-cylindrical like the bottom.

11. The mixer of claim 1 wherein the maximum radial dimension of the blades is less than the inside radius of the semi-cylindrical bottom by ⅛ to ½ inch.

12. The mixer of claim 11 wherein the thickness of the blades is 1/16 to ⅜ inch.

13. The mixer of claim 1 wherein the blades mounted on the shaft project therefrom in radial directions that are spaced from one another by equal angles of 90°, 120° or 180°.

14. The mixer of claim 1 wherein the discharge opening is in the semi-cylindrical bottom of the vessel.

15. The mixer of claim 1 wherein the electric motor can rotate the shaft at variable speeds in the range of 900 to 5000 RPM.

16. The mixer of claim 1 wherein the vessel can be tilted so that the end with the discharge opening is higher than the opposite end.

17. The mixer of claim 1 wherein the feed opening has a screw conveyor connected thereto.

* * * * *

UNITED STATES PATENT AND TRADEMARK OFFICE

CERTIFICATE OF CORRECTION

PATENT NO. : 5,100,240

DATED : March 31, 1992

INVENTOR(S) : Joseph C. D'Alterio

It is certified that error appears in the above-identified patent and that said Letters Patent is hereby corrected as shown below:

Column 7, line 35, before "facing" insert --having said tapered knife edge--.

Signed and Sealed this

Fifteenth Day of June, 1993

Attest:

Michael K. Kirk

MICHAEL K. KIRK

Attesting Officer

Acting Commissioner of Patents and Trademarks